United States Patent [19]

Schantz

[11] 4,145,821

[45] Mar. 27, 1979

[54] RUG DRYER

[76] Inventor: Robert I. Schantz, P.O. Box 2, Lakeview Station, Tacoma, Wash. 98491

[21] Appl. No.: 816,324

[22] Filed: Jul. 18, 1977

[51] Int. Cl.[2] ..... F26B 25/10; F26B 25/18

[52] U.S. Cl. ..... 34/237

[58] Field of Search ..... 34/237, 151; 417/84, 417/158

[56] References Cited

U.S. PATENT DOCUMENTS

| | | | |
|---|---|---|---|
| 2,306,727 | 12/1942 | Hill | 417/84 |
| 3,259,996 | 7/1966 | Hall et al. | 34/237 X |
| 3,286,368 | 11/1966 | Thomas | 34/151 |
| 3,287,820 | 11/1966 | Gibson | 34/151 |
| 3,324,846 | 6/1967 | Smith | 34/243 R |
| 3,409,996 | 11/1968 | Konstandt | 34/151 |

*Primary Examiner*—Carlton R. Croyle
*Assistant Examiner*—R. E. Gluck
*Attorney, Agent, or Firm*—Roy E. Mattern, Jr.

[57] ABSTRACT

After rugs have been cleaned in place in dwellings using liquids, even though the cleaning operations involve the vacuuming of then dirty cleaning liquids from the rug, considerable moisture is left in the rugs. To remove this residual moisture this rug dryer is centered over a large rug area. Then during drying operations the dryer blower fan draws room air in from above and directs the room air downwardly toward the rug for distribution along the floor and through the rug fibers in multiple directions away from the fan, while being directionally controlled near the rug, below a continuous floating and fluttering layer of an air impervious material extended over a large area of the rug. In a preferred embodiment, the axis of the dryer blower fan is arranged vertically and the fan housing of the blower assembly is mounted above the rug on small diameter legs. Also the fan housing of the blower assembly has a spaced outer ring to which the air impervious material is attached. Primary air is drawn down through the fan and secondary air is drawn down through the surrounding area between the fan housing and the spaced outer ring, supplementing the downwardly moving primary air leaving the fan, thereby creating a large flowing volume of drying air moving below the air impervious material over and through the rug fibers.

10 Claims, 2 Drawing Figures

RUG DRYER

BACKGROUND OF THE INVENTION

In the deep steaming rug cleaning operations, although the released high pressure hot water is, almost immediately after its cleaning function, attempted to be fully vacuumed from the rug, in practice, more moisture remains in the rug than is desirable. To subsequently remove the excess moisture, standing fans revolving on horizontal axes have been used to keep drying air moving over the rug and through the room, where the wall to wall carpeting is being cleaned or has been cleaned. Also hand pushed carpet and rug dryers, such as disclosed by William F. Thomas in his U.S. Pat. No. 3,286,368 have been used. In Mr. Thomas' rug dryer, air is drawn down from above through the fan volume, then on through heating coils, thereafter directed downwardly into the rug, and then outwardly from below the housing of his carpet and rug dryer. Personnel must constantly attend and move the Thomas type dryer. Also the large room air circulating fans are not too efficient with respect to either drying time period or energy needed to complete the drying. There remained a need for more quickly and efficiently drying large areas of rugs without the need for extra persons serving as constant monitoring or operating personnel during the drying time.

SUMMARY OF THE INVENTION

A rug dryer is placed with its center at the center of a large area of rug to be dried such as a rug in a living room or office. Then the blower assembly of the dryer is turned on to draw room air from above down through the housing surrounding the blower fan, and also adjacent the housing for its discharge over, nearby and through fibers of the entire area of the rug, while guided by material, preferably impervious, surrounding the blower assembly and extending in all directions therefrom to cover a large rug area. After a short and effective operating time the rug dryer is turned off and conveniently moved to the center of a rug in another room, or moved to a new location in a very large room such as a banquet room. Then it is operated again to dry a large area, and the person who moved the dryer goes elsewhere to perform a rug cleaning or drying function for the rug being dried by this rug dryer does not then need constant attention.

DESCRIPTION OF THE DRAWINGS

The preferred embodiment of the rug dryer is illustrated in the accompanying drawing, wherein.

DESCRIPTION OF THE PREFERRED EMBODIMENT

Figure 1:
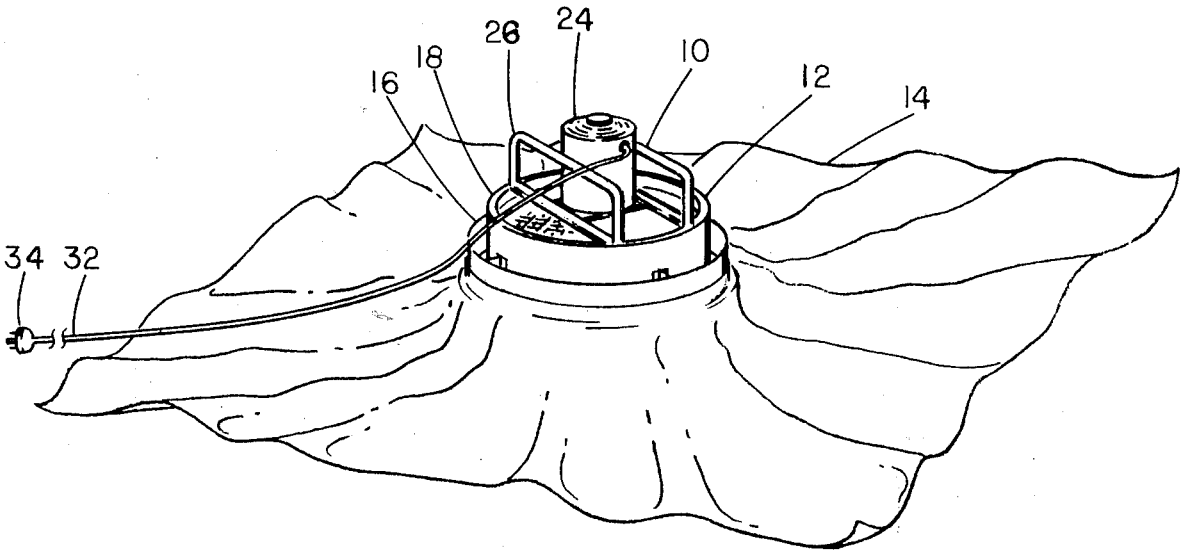
FIG. 1 is a perspective view of the rug dryer positioned in the center of the large rug area to be dried.
Figure 2:
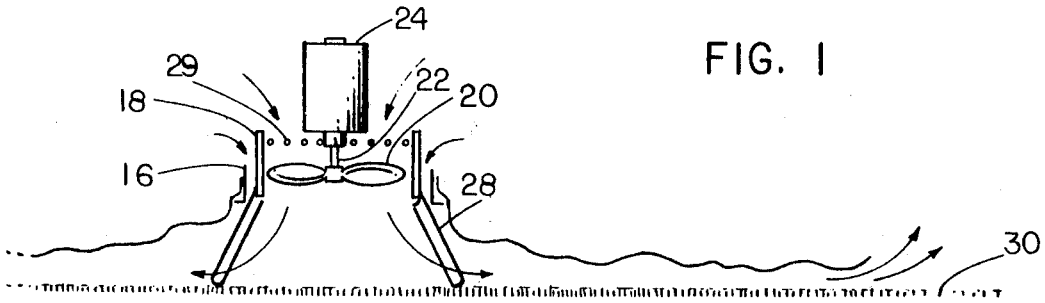
FIG. 2 is a partial sectional view of the rug dryer placed over the rug and operated to dry the rug, the directional arrows indicating the downward flow of room air through the blower fan and also adjacent the fan housing for subsequent extensive distribution below the extended and fluttering impervious material which covers a large area of the rug being dried.

After rugs have been cleaned while in place in dwellings such as homes, offices, and restaurants, by methods utilizing some selected liquids, even though the method used, such as the injection of hot water under pressure into the rug and the almost immediate vacuuming of the water, with loosened debris and dirt, is undertaken to leave a clean rug reasonably dry, there is a need for more thorough drying in a shorter time. A rug dryer conveniently and efficiently operated to complete the rug drying is illustrated in FIGS. 1 and 2, in a preferred embodiment.

The rug dryer 10, has a blower assembly 12 surrounded by a large area of material 14, which is preferably impervious. Preferably this material 14 is removably secured to a ring 16 spaced around the housing 18 of the blower fan 20. The fan 20 is mounted on a vertical shaft 22, in turn secured to the electric drive motor 24. The motor 24 is mounted on a multipiece frame 26 secured to the top of the housing 18. At the bottom of the housing 18, three or more small diameter legs 28 are secured to the bottom of the housing, preferably at a stabilizing angle, to keep the blower assembly 12 at the preselected height above the carpet being dried. The height selected utilizes the full capacity of the blower fan 20 to circulate the drying air close to the rug 30 and through fibers of the rug, while being radially ejected below the impervious material 14, often referred to as the guiding blanket 14. A protective screen 29 is installed across the housing 18 above the blower fan 20.

In addition to the room air drawn primarily through the housing 18 around the blower fan 20, air is also drawn secondarily alongside the housing inside of the ring 16 to join the air leaving the blower fan 20. The combined primary and secondary air exit through the spaced legs 28 and travel below the guiding blanket 14 of preferably impervious material to effectively dry the rug 30. The effectiveness of this drying is enhanced because during the drying operation, this impervious blanket material 14 actively floats on this flow of combined airs, being restrained only by its central attachment to the fan ring 16. This blanket 14 is constantly undergoing a wave-like motion which beneficially continues to modify the exiting air flow to increase the effectiveness of the drying operation.

To move the rug dryer 10 to another location, its electrical power lead 32 is unplugged and the plug 34 and lead 32 are easily gathered together with both the impervious material blanket 14 and the entire blower assembly 12. Then the entire rug dryer 10 is moved to another location in the center of a large rug area which needs drying, and the steps are reversed. The impervious material blanket 14 is spread over the rug 30, and the electrical lead 32 and plug 34 are used to bring motive power to the rug dryer 10. Once in operation, the operator may leave to continue cleaning rug areas while this area below the extensive floating and guiding blanket is being dried by the operating rug dryer 10.

I claim:

1. A rug dryer for placement over large rug areas to further dry rugs, previously cleaned and vacuumed in place, to operate during the drying period without the necessity of a constantly attending operator, comprising:

a. a blower assembly arranged for placement over a rug to draw room air in from above over the rug and discharge the room air below into and across the fibers of the rug; and b. a large piece of material arranged around the blower assembly and extending beyond to cover a large rug area, and, during operation of the blower assembly, to be raised throughout its entirety and to be moved in a wave-like motion by the air flow, above the rug area while guiding the blown room air, then serving as the effective drying air, discharged from the blower assembly, to all the outer edges of this large piece of material for its ultimate discharge laden with moisture.

2. A rug dryer, as claimed in claim 1, wherein a ring is spaced from and secured about the blower assembly in the same geometric plane of the blower discharge and the large piece of material is arranged about the ring leaving a space around the blower assembly and between the ring through which room air from above is drawn directly down during operation of the blower assembly, thereby combining, in the same geometric plane, the primary air going through the blower assembly with the secondary air passing alongside the blower assembly, thereby effectively increasing the volume of room air being used to dry the rug area under the rug dryer.

3. A rug dryer, as claimed in claim 1, wherein the large piece of material is made of impervious material which is light enough to be moved throughout its entirety in a wave-like motion.

4. A rug dryer, as claimed in claim 1, wherein the blower assembly, in turn, comprises:

a. a housing b. legs secured to the housing, placing the housing in a horizontal position, a preselected distance above the rug;

c. a frame secured to the housing;

d. a motor secured to the frame; and e. a blower fan having a vertical axis supported and driven by the motor.

5. A rug dryer, as claimed in claim 4, wherein a ring is secured around the housing at a uniform circular space and then the large piece of material is rearranged to be secured to this ring thereby increasing the entry for room air drawn in from above the rug.

6. A rug dryer, as claimed in claim 5, wherein the large piece of material is made of impervious material which is light enough to be moved throughout its entirety in a wave-like motion.

7. A rug dryer, as claimed in claim 6 wherein a screen is secured to the housing above the blower fan to prevent unwanted objects from entering the blower.

8. A rug dryer, as claimed in claim 7, where the motor utilizes electrical power and its axis is arranged vertically.

9. A rug dryer, as claimed in claim 7, wherein the axes of the motor and blower fan are arranged vertically and in align.

10. A rug dryer, as claimed in claim 9, wherein the legs are at least three in number and of such height and diameter so as not to restrict the flow of room air, serving as the drying air, while being guided below the large piece of material and through and over the fibers of the rug and ultimately being continuously discharged below the continuous edge of the large piece of material as it undergoes its wave-like motion.

* * * * *